US006266834B1

(12) United States Patent
Walsh et al.

(10) Patent No.: US 6,266,834 B1
(45) Date of Patent: Jul. 31, 2001

(54) MULTI-FUNCTIONAL ROOFING TOOL

(75) Inventors: Tom Walsh, Agua Dulee; John Gilchrist, Saugus, both of CA (US); Leonard Peterson, 2908 Via Hidalgo, San Clemente, CA (US) 92673

(73) Assignee: Leonard Peterson, San Clemente, CA (US)

( * ) Notice: Subject to any disclaimer, the term of this patent is extended or adjusted under 35 U.S.C. 154(b) by 0 days.

(21) Appl. No.: 09/488,224

(22) Filed: Jan. 19, 2000

(51) Int. Cl.[7] ..... B25D 1/04
(52) U.S. Cl. ..... 7/144; 81/45
(58) Field of Search ..... 7/114, 144, 145, 7/158, 159; 81/20, 45

(56) References Cited

U.S. PATENT DOCUMENTS

| | | | | |
|---|---|---|---|---|
| 20,052 | * | 4/1858 | English | 7/145 |
| 99,470 | * | 2/1870 | Perham | 7/145 |
| 103,660 | * | 5/1870 | Rock | 81/20 |
| 199,959 | * | 2/1878 | Chapman | 7/145 |
| D. 266,902 | * | 11/1982 | Tarran . | |
| D. 289,729 | * | 5/1987 | Porter et al. . | |
| 440,962 | * | 11/1890 | Pettingell | 30/308.1 |
| 3,233,643 | * | 2/1966 | Reuterfors | 7/158 |
| 3,927,432 | * | 12/1975 | Dahl | 7/145 |
| 5,025,520 | * | 6/1991 | Watkins . | |
| 5,315,725 | * | 5/1994 | Vanden Heuvel . | |

* cited by examiner

*Primary Examiner*—Derris H. Banks
*Assistant Examiner*—David B. Thomas
(74) *Attorney, Agent, or Firm*—Sharon Roddan, Esq.

(57) ABSTRACT

A multipurpose hand-held tool having a handle and a head wherein the head has a plurality of implements. The head has a middle portion, which is connected the handle, a first head end and a second head end. The first head end has three cutters such that there is a cutting edge on the top side, the end, and the bottom side of the first head. The first head end also includes a plurality of gauge holes in the top side, and a nail slot on the bottom side. The second head end includes both a hammer head connected to the end and a hammer claw connected to the top side of the second head end. The multipurpose hand-held tool meets a need for roofers to have a multipurpose tool which helps to quickly, efficiently and accurately remove and replace roofing materials.

2 Claims, 3 Drawing Sheets

FIG. 4
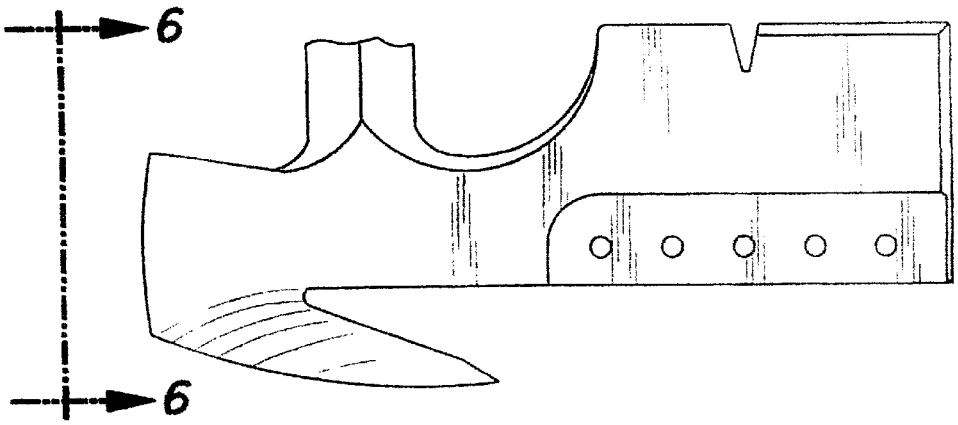
FIG. 5
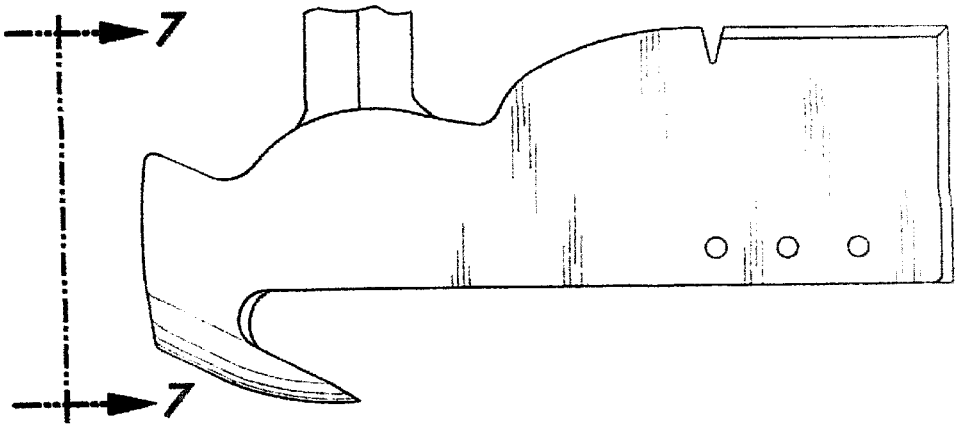
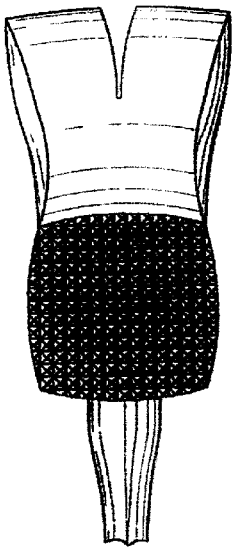
FIG. 6
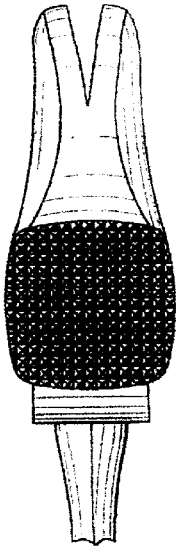
FIG. 7

MULTI-FUNCTIONAL ROOFING TOOL

BACKGROUND OF THE INVENTION

1. Field of the Invention

This invention relates to hand-held striking tools, such as hammers and hatchets, and in particular to hand-held tools for roofers having a need for a multipurpose tool to quickly, efficiently and accurately remove and replace roofing materials.

2. Description of the Prior Art

This invention relates to a new multipurpose hand-held tool and the methods of using it, and more particularly to a combination roofing tool and method of use which allows a roofer the ability to hatchet, hammer, remove nails, pry off old roofing materials and measure the distance to quickly and accurately lay new shingles on a roofing surface.

In the past, it has been conventional to require the roofer to carry several tools to perform this function. The necessity for carrying these devices are obviously not convenient for a roofer to use, places the roofer at additional risk of injury and inefficiency by requiring that the roofer carry additional heavy extra tools for performing these multiple tasks.

Heretofore, manufacturers of tools for roofing but have not provided tools that are capable of multi-tasking. Rather, until the present invention a roofer must bring along an assemblage of separate tools for cutting, prying, hammering and measuring. This is difficult and very burdensome for a roofer. Being burdened with a plurality of tools to accomplish these separate functions slows down the roofer and diminishes his or her efficiency, tires the roofer out from the multiple tools and places the roofer in greater danger due to the danger associated with multiple tools upon a sloped roofing surface. Presently, no manufacturer of hand-held roofing tools provides a simple tool with these multiple features eliminating the need for many separate tools.

It has, of course, been known to combine functions with a single tool to avoid the need to carry multiple tools. For example, in U.S. Pat. No. 4,581,782 there is a hammer described which contains both a vertical and horizontal level in the handle so that a carpenter may level horizontally each nail to be nailed in place just prior to driving the nail.

Whereas, U.S. Pat. No. 3,740,799 discloses a surgical tool which comprises a surgical scalpel having a scalpel blade at one end and a series of metered markings on the shaft so as to make longitudinal measurement as well as a device for measuring the circumferential diameter of an orifice or mouth of a tube or duct at the other end of the tool.

Similarly, U.S. Pat. No. 2,952,025 shows the combination of a cutting knife and a tape measure in the handle to facilitate cuts.

U.S. Pat. No. 5,025,520 discusses a combined tool and method for using a retractable knife and pitch gage to provide pitch measurements for roofers.

And U.S. Pat. No. 5,315,725 discloses a hand-held tool for rescue workers to extract victims from damaged motor vehicles, including a handle, a head, a foot, and a saw blade that projects from the bottom of the foot.

However, until now, no one invented a satisfactory multipurpose roofing tool which provides for easy use and worker efficiency and can perform all of the operations of cutting, hammering, prying, pulling and measuring in a single tool. Furthermore, tools presently available for, in particular, roofing applications are not adequate to assure with the one simple and relatively inexpensive tool, a means for cutting, hammering nails, extracting nails, prying off old roofing materials and measuring the distance between shingles when laying new shingles.

On the contrary, while the foregoing body of prior art indicates it to be will known to used hand held tools for cutting and prying or cutting and measuring, the provision of a simple and cost effective device such as the one disclosed in this invention is not contemplated which can perform all of the operations of cutting, prying pulling, hammering and measuring in a single tool. The foregoing disadvantages are overcome by the unique multipurpose tool of the present invention as will be made apparent from the from the following description.

SUMMARY OF THE INVENTION

To achieve the foregoing and other advantages, the present invention, briefly described, provides a new and improved multipurpose hand-held tool, especially adapted for use by roofing workers for the rapid removal and accurate replacement of shingles and other roofing materials.

This tool includes a handle and a head. The head is connected to the handle and includes a first head end, a top head portion, and a second head end, and a bottom head portion.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be found in the accompanying drawings and descriptive matter in which there are illustrated preferred embodiments of the invention.

It is the object of the present invention to overcome the foregoing problems and disadvantages encountered in the prior art with respect to a practical, multi-functional roofing tool, which permits the easy removal and installation of shingles and other building materials.

In a first embodiment, a first cutter or hatchet-like blade device, is connected to the first head end and has a sharp, blade edge which is especially adapted to cut or chop shingles or other roofing materials. A second cutter is connected to the bottom of the first head end has a flat, axe-like blade capable of performing functions similar to that of an axe. The second cutter which is connected to the bottom of the first head end may also have a nail slot for pulling nails. A third cutter is connected to the top of the first head end and also has a flat, axe-like blade capable of performing functions similar to that of an axe. In addition, the third cutter connected to the top of the first head end also has a plurality of gauge holes capable of allowing the roofer to quickly and evenly space the new shingles. A second head end has a hammerhead affixed thereto. The second head end is adapted to hammer nails and includes a hammerhead that can be used as a conventional hammer or this second end may also be kicked with the toe of the roofer's shoe or boot. When this end is kicked it forces the first head end under existing roofing material and provides rapid and efficient removal of existing roofing materials. A nail remover or claw is connected to the top of the second head end and may also be used for prying off unwanted roofing materials.

In a second embodiment, top of the second head end may be smaller and lighter and includes a bifurcated claw having two pointed hooked tips, commonly referred to as a "cat's claw" which has been adapted for removing nails and for prying and includes a pointed, tapered opening which is especially adapted to add or to remove a smaller roofing nail, such as, for example, from a three to sixteen penny nail or smaller.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be covered by the claims appended hereto.

In this respect, before explaining a preferred embodiment of the multipurpose tool of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multipurpose tool that has all of the advantages of the prior art and none of the disadvantages.

It is another object of the present invention to provide a new and improved multipurpose tool which may be easily and efficiently manufactured and marketed.

It is a further object of the present invention to provide a new and improved multipurpose tool that is of durable and reliable construction.

An even further object of the present invention is to provide a new and improved multipurpose tool which is susceptible of a low cost of manufacture with regard to both materials and labor, and which accordingly is then susceptible of low prices of sale to the consuming public, thereby making such multipurpose tool available to the buying public.

Still yet a further object of the present invention is to provide a safer, new and improved multipurpose tool that improves the efficiency of a roofing worker by obviating the need to bring many tools to the work site, and therefore requiring the roofer to carry less tools for the job.

Yet another object of the present invention is provide a roofer with a single tool that could be used to carry out a plurality of functions such as cutting, prying, measuring, and hammering during a roofing job.

Moreover, no tool presently available performs the foregoing functions, and in addition, this novel invention has the additional capability of extracting nails from either direction using the claw portion of the handle to achieve maximum leverage.

BRIEF DESCRIPTION OF THE DRAWINGS

These and other features, objects and advantages of the present invention will become more apparent from the following detailed description of a presently preferred embodiment, when taken in conjunction with the accompanying drawings herein.

FIG. 4 is a cross-sectional view taken along plane 6—6, depicting the unique features of the multi-functional roofing tool.

FIG. 5 is a cross-sectional view of cross-plane 7—7.

FIG. 6 is a side view showing the side of the preferred embodiment.

FIG. 7 is a side view showing the alternative embodiment of the invention.

DETAILED DESCRIPTION OF THE EMBODIMENTS

Figure 1:
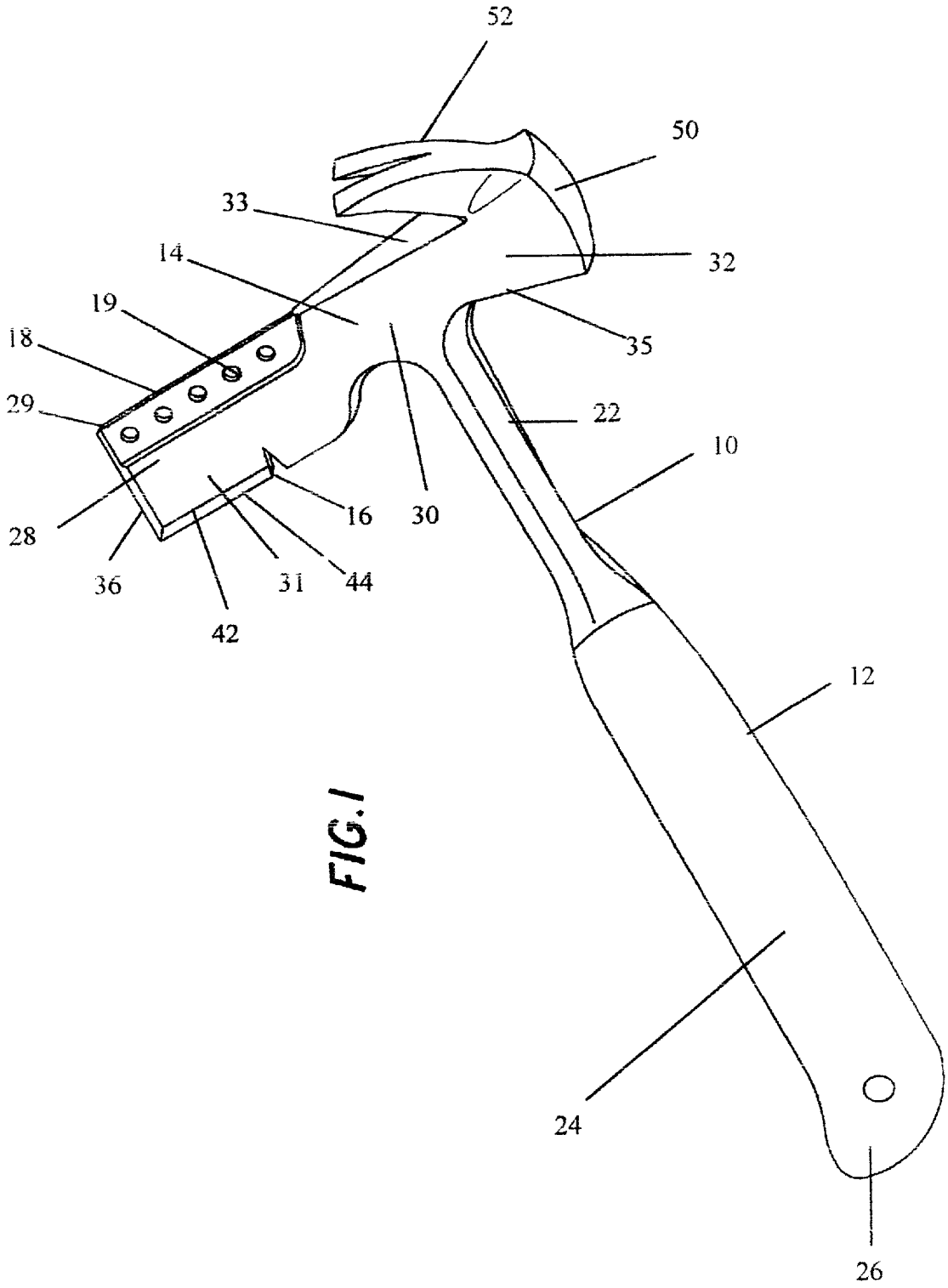
FIG. 1 is a perspective view of the multi-functional roofing tool of the present invention in its assembled state.

With reference to the drawings, a new and improved multipurpose tool embodying the principles and concepts of the present invention will be described.

Turning initially to FIGS. 1–4, there is shown a first preferred embodiment of the multipurpose tool of the invention generally designated by reference numeral 10. In its preferred form, multipurpose tool 10 includes a handle 12 and a head 14.

The handle 12 includes an upper handle portion 22, a middle handle portion 24, and a lower handle portion 26 where the middle handle portion 24 is grasped by a hand of a user.

The head 14 includes a first head end 28, a middle head portion 30, and a second head end 32. The middle head portion 30 is connected to the upper handle portion 22. The first head end 28 has a topside 29 and a bottom side 31. The second head end 32 has a top side 33 and a bottom side 35. A first cutter 36, which is a broad, flat, sharpened edge like a hachet blade, is connected to the first head end 28 and is located between the top side 29 and the bottom side 31 of the first head end 28.

A second cutter 42 is connected to the first head end 28 at a location spanning the bottom side 31 of the first head end 28. The second cutter 42 has a long, flat, axe-like blade 44 and performs functions similar to that of an axe. The axe-like blade 44 is readily capable of cutting through all types of roofing materials. In addition, there is shown a nail slot 16 in the bottom side 31 of the first head 28.

A third cutter 18 is connected to the first head end 28 at a location spanning the top side 29 of the first head end 28. The top side 29 of the first head end 28 has a plurality of gauge holes 19 for evenly measuring the spacing between shingles or other roofing materials.

The head includes a second head end 32. The second head end 32 has a top side 33 and a bottom side 35. A conventionally shaped hammer head 50 is connected to the second head end 32 and is located between the top side 33 and the bottom side 35 of the second head end 32 and may be used as a conventional hammer or as a kick plate to force the first cutter 36 of the first head end 28 under existing roofing materials to pry said roofing materials free. A claw 52 is connected to the second head end 32 at a location on the top side 33 of the second head end 32. The claw 52 may be used from either direction, as shown in FIG. 2 and FIG. 3 for maximal leverage in pulling or prying a nail.

In the first embodiment of the invention shown in FIGS. 1–4, and FIG. 6 the claw is of a conventional configuration.

Figure 2:
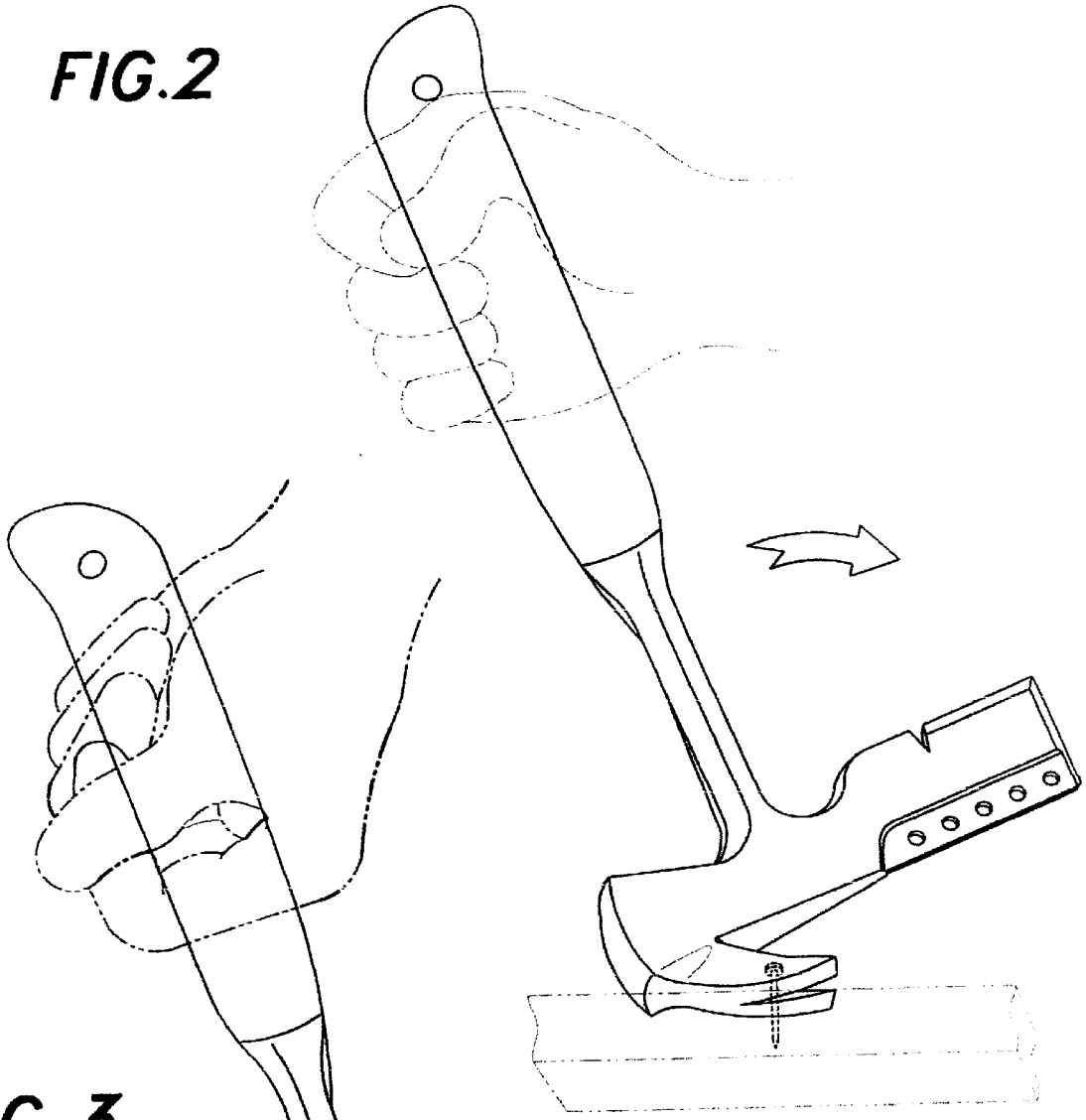
FIG. 2 is a perspective view of the claw end of the roofing tool being used to remove a nail from one direction.
Figure 3:
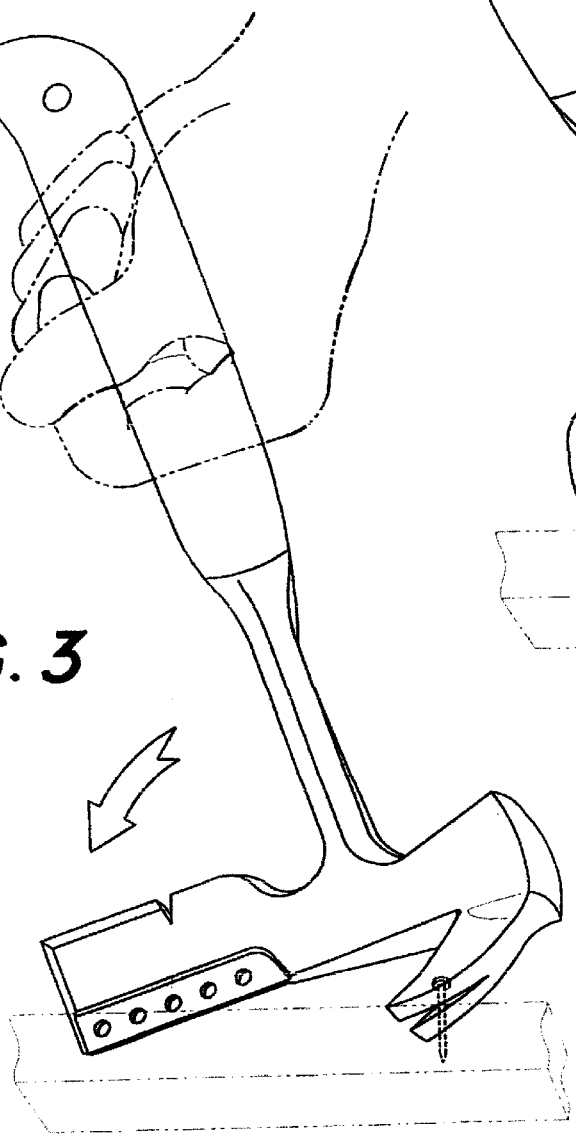
FIG. 3 is a perspective view of the roofing tool wherein the claw end of the roofing tool being used to remove a nail from the opposite direction.

The views shown in FIGS. 2 and 3 further illustrate the first preferred embodiment of the multipurpose tool 10 of the invention.

Turning to FIGS. 5 and 7, there is shown a second preferred embodiment of the multipurpose tool of the invention generally designated by reference numeral 10. In this preferred form, multipurpose tool 10 includes a handle 12, and a head 14. In the second preferred embodiment, as shown in FIGS. 5 and 7, the claw 54 is smaller, narrower, tapered and pointed, as a "cat's claw", in order to permit the user to utilize the multifunctional tool with smaller nails, such as, for example, sixteen penny nails and finishing nails, such as those used by finish carpenters.

The handle 12 includes an upper handle portion 22, a middle handle portion 24, and a lower handle portion 26 where the middle handle portion 24 is grasped by a hand of a user.

The head 14 includes a first head end 28, a middle head portion 30, and a second head end 32. The middle head portion 30 is connected to the upper handle portion 22. The first head end 28 has a topside 29 and a bottom side 31. The second head end 32 has a top side 33 and a bottom side 35. A conventionally-shaped hammerhead 60 is connected to the first head end 28.

A first cutter 36, which is a broad, flat, sharpened edge like a hatchet blade, is connected to the first head end 28 and is located between the top side 29 and the bottom side 31 of the first head end 28.

A second cutter 42 is connected to the first head end 28 at a location spanning the bottom side 31 of the first head end 28. The second cutter 42 has a long, flat, axe-like blade 44 and performs functions similar to that of an axe. The axe-like blade 44 is readily capable of cutting through all types of roofing materials. In addition, there is shown a nail slot 16 in the bottom side 31 of the first head 28.

A third cutter 18 is connected to the first head end 28 at a location spanning the top side 29 of the first head end 28. The top side 29 of the first head end 28 has a plurality of gauge holes 19 for evenly measuring the spacing between shingles or other roofing materials.

The second head end 32 includes a bifurcated claw end 60 having two pointed hooked tips 62 for pulling nails and for prying.

As mentioned above, the embodiments of the multipurpose tool 10 of the present invention are especially useful to roofers who wish simplify the need to carry a separate tool to hammer, nail, pry, pull, cut, and measure roofing materials.

It is apparent from the above that the present invention accomplishes all of the objects set forth by providing a new and improved multipurpose tool that is low in cost, relatively simple in design and operation, and which may advantageously be used by a roofing worker to simplify and facilitate the removal and placement of roofing materials and provides a roofer with a single tool that could be used to carry out the plurality of functions of cutting, prying, measuring and hammering.

With respect to the above description, it should be realized that the optimum dimensional relationships for the parts of the invention, to include variations in size, form, function and manner of operation, assembly and use, are deemed readily apparent and obvious to those skilled in the art, and therefore, all relationships equivalent to those illustrated in the drawings and described in the specification are intended to be encompassed by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A multipurpose hand-held tool, comprising:

a handle including an upper handle portion, a middle handle portion, and a lower handle portion, said middle handle portion for being grasped by a hand;

a head including a first head end, a middle head portion, and a second head end, said middle head portion connected to said upper handle portion, said first head end and said second head end having a respective top side and a bottom side;

a first cutter connected to said first head end;

a second cutter connected to said bottom of said first head end;

a third cutter connected to the top side of said first head end;

a nail slot formed at the bottom side of said first head end;

a plurality of gauge holes formed at the top side of said first head end;

a hammer head connected to said second head end, and;

a hammer claw connected to the top side of said second head end of said multipurpose tool.

2. The tool described in claim 1 wherein said hammer claw is a bifurcated claw, including two pointed hooked tips, connected to said second head end of said multipurpose tool.

* * * * *